United States Patent [19]

Walker et al.

[11] 4,429,725

[45] Feb. 7, 1984

[54] DISPENSING NOZZLE FOR VACUUM ASSIST VAPOR RECOVERY SYSTEM

[75] Inventors: Donald C. Walker, Munster, Ind.; Theodore O. Wagner, St. Charles, Ill.

[73] Assignee: Standard Oil Company (Indiana), Chicago, Ill.

[21] Appl. No.: 335,637

[22] Filed: Dec. 30, 1981

[51] Int. Cl.[3] ..... B65B 3/18

[52] U.S. Cl. ..... 141/59; 141/302

[58] Field of Search ..... 141/192–229, 141/285–310, 37, 39–64, 93, 392

[56] References Cited

U.S. PATENT DOCUMENTS 4,199,012 4/1980 Lasater ..... 141/59

4,223,706 9/1980 McGahey ..... 141/59

*Primary Examiner*—Houston S. Bell

*Attorney, Agent, or Firm*—Lansing M. Hinrichs; William T. McClain; William H. Magidson

[57] ABSTRACT

A liquid dispensing nozzle suitable for use in automobile service stations having vacuum assist vapor recovery systems is disclosed. This nozzle incorporates a check valve for closing the vapor return conduit means at all times when liquid is not being dispensed and a liquid responsive means in the vapor return conduit means for automatically shutting off the dispensing of liquid in the event liquid is aspirated into the vapor return conduit means.

4 Claims, 1 Drawing Figure

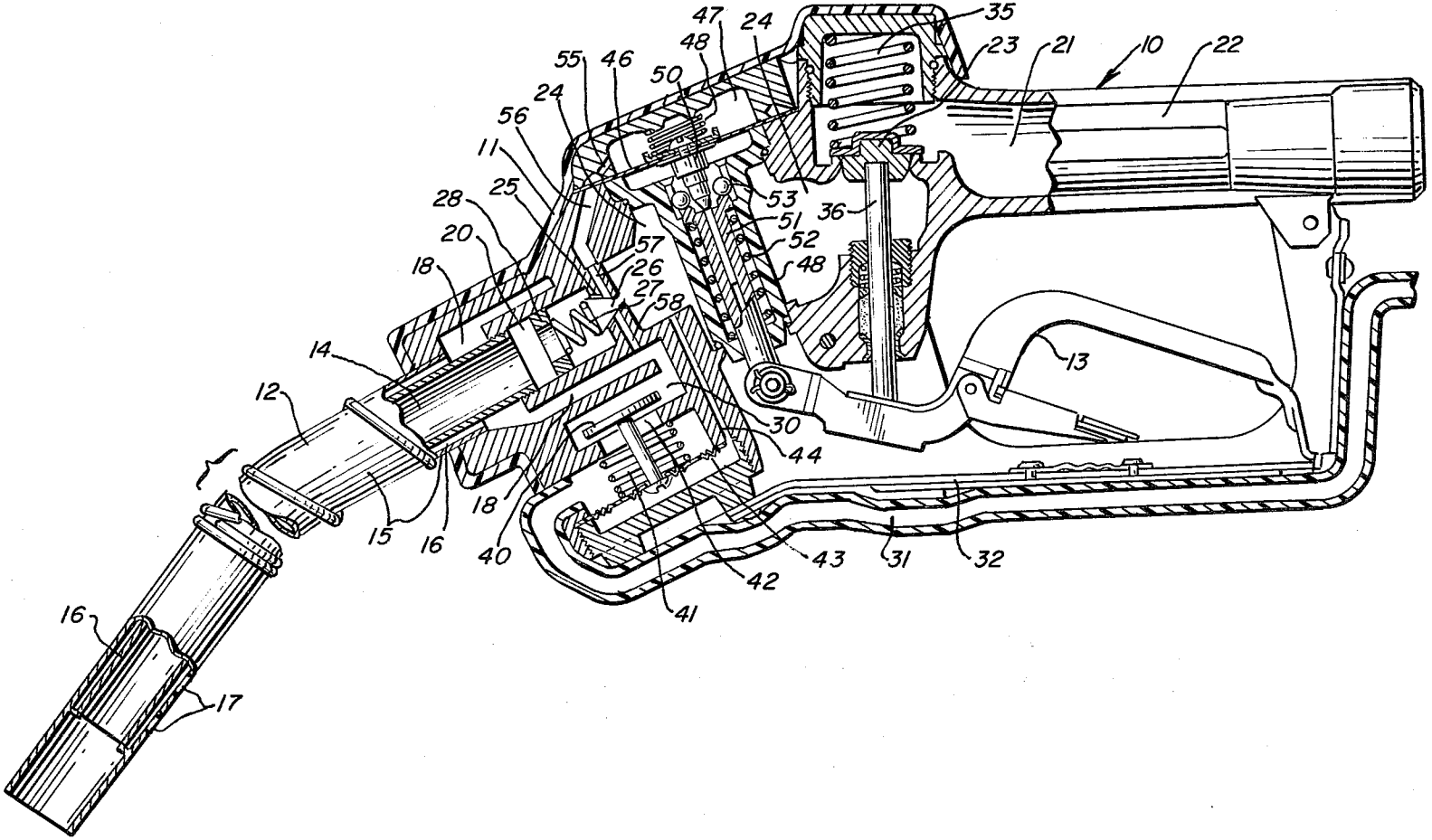
10
11
12
13
14
15
16
17
18
20
21
22
23
24
25
26
27
28
30
31
32
35
36
40
41
42
43
44
46
47
48
50
51
52
53
55
56
57
58

DISPENSING NOZZLE FOR VACUUM ASSIST VAPOR RECOVERY SYSTEM

BACKGROUND OF THE INVENTION

This invention relates to liquid dispensing systems having vapor recovery means such as are employed in automobile service stations where fuels are dispensed from storage tanks to receptacle tanks on vehicles and vapors from the vehicle receptacle tanks are withdrawn from the tanks and the surrounding atmosphere and are returned to the storage tank. Vapor recovery systems may be classified in two categories, namely, balanced pressure systems and vacuum assist systems. In the former, a sealing arrangement such as an elastomeric boot is provided which engages the vehicle fill pipe during fueling operations in sealing relationship. The interior of the boot is connected through a vapor return conduit to the underground storage tank and by this means, vapors forced out of the vehicle tank as it is filled are returned to the storage tank where they are largely recovered.

The vacuum assist system differs from the balanced pressure system in that in the vacuum assist system no sealing arrangement with the fill pipe is provided. Instead, conduit means associated with the dispensing nozzle and connected through a vacuum pump or other vacuum inducing means, are employed to collect vapors emerging from the vehicle tank and from the vicinity of the fill pipe and conduct them through a conduit back to an appropriate storage tank, thus effecting recovery of the fuel and preventing atmospheric pollution.

The dispensing nozzle of the present invention has particular utility when utilized in a vacuum assist system. Such a system is described in U.S. patent application Ser. No. 36,302 of Donald C. Walker et al. for "Vapor Recovery System and Nozzle" filed May 7, 1979 and assigned to the same assignee as the present application. U.S. patent application Ser. No. 36,302 is hereby incorporated by reference. In this application the vacuum for aspirating the vapors from the vehicle tank and vicinity is preferably provided by a pump which is driven by an hydraulic motor actuated by fuel flowing through a service station dispensing unit. A somewhat similar arrangement is disclosed in U.S. Pat. No. 3,913,633 to Hiller. Hiller discloses a vacuum assist system in which an injector is used to create a vacuum in response to the dispensing of liquid from the storage tank. U.S. Pat. No. 3,826,291 to Steffins discloses a vacuum assist system in which the vacuum is provided by a vapor pump driven by the shaft of the meter which operates an indicator of the amount of liquid dispensed. U.S. Pat. No. 4,058,147 to Stary et al. discloses a vacuum assist system in which a motor driven vapor pump is employed to produce a vacuum at the dispensing nozzle. A means, responsive to the flow of liquid through the nozzle, to automatically open a vapor valve to an extent proportional to the rate of liquid flow through the nozzle is provided.

U.S. Pat. No. 4,286,635 to McMath discloses a dispensing nozzle for use in a balanced pressure type system. The McMath nozzle has a vacuum tube disposed within the central portion of the nozzle spout for sensing the presence of liquid in the fill pipe when the tank is filled. When this tube is blocked by liquid, diaphragm means actuate a shut-off valve to cut off liquid flow. McMath also has a diaphragm operable in response to pressure within the vehicle tank to shut off liquid flow when a predetermined tank pressure is exceeded. This latter feature is, of course, not useable in vacuum assist type systems which do not have a seal formed between the nozzle and the vehicle tank fill pipe. The McMath patent is also of interest in that it discloses a means for sealing the vapor return conduit from the atmosphere when the nozzle is not in use. In McMath a retainer ring on the nozzle spout is adapted to engage an elastomer sealing on the end of the vapor return boot when the spout is not received in the fill pipe.

U.S. Pat. No. 4,276,916 to Ostand discloses a dispensing nozzle for a balanced pressure type system similar to McMath but having a float in the vapor return conduit responsive to the presence of a predetermined quantity of liquid which causes an actuator or transducer to be activated to shut off liquid flow through the nozzle in the event the vacuum tube within the spout should fail to function and stop the flow.

In an effective vacuum assist type vapor recovery system the following requirements must be met:

(1) The conduit for conducting liquid from the storage tank to the dispensing nozzle must be sealed closed except when liquid fuel is being pumped.

(2) This conduit also must be closed to stop the pumping of liquid when the vehicle tank is filled to a predetermined level to prevent spillage on the ground.

(3) The vapor return conduit from the nozzle back to the storage tank or other collection point must be open when liquid is being pumped into the vehicle tank and must be sealed closed when liquid is not being dispensed and a partial vacuum is not present in this conduit.

(4) Liquid must not be aspirated into the vapor return conduit from the vehicle tank or fill pipe or from other parts of the nozzle. Otherwise customers would be charged for fuel which was aspirated back to the storage tank after having passed through a registering dispenser.

A large majority of the dispensing nozzles now in use employ a vacuum sensing line within the spout of the kind shown and described in U.S. application Ser. No. 36,302 as well as in the McMath and Ostand patents described above. The use of such an arrangement has several disadvantages. For example, splashing liquid may momentarily block the vacuum line causing actuation of the shut-off mechanism and premature shut-off before the vehicle tank is filled. Moreover, as pointed out by Ostand (Column 1, lines 34–35), in a vapor recovery system it is not always certain that the shut-off means will function to prevent liquid flow through the vapor return conduit because of faulty positioning of the spout in the fill pipe. Another disadvantage of the vacuum sensing line in the spout arrangement, particularly in vacuum assist system such as that described in Ser. No. 36,302 where the annular vapor return conduit is disposed within the spout, is that the vacuum sensing line occupies volume within the inner conduit and impedes liquid flow. In this connection it should be noted that the current arrangement in which "lead restrictor" plates are installed in fill pipes of vehicles equipped with catalytic converters limits the outer diameter of the spout and this in turn limits the diameter of the inter spout conduit.

A principal object of the present invention is to provide a foolproof dispensing nozzle satisfying all of the requirements enumerated above and which does not employ a vacuum sensing conduit within the fuel passage of the spout.

Another object is to provide a system which is hydraulically and pneumatically actuated deriving the power to actuate the various elements from the fluid streams.

SUMMARY OF THE INVENTION

The automatic shut-off nozzle of this invention is adapted to be utilized in a vacuum assist type vapor recovery system and comprises:

(a) a nozzle body having an inlet and an outlet for liquid to be dispensed;

(b) a filling spout attached to the nozzle body adapted for loose fitting reception in a vehicle tank fill pipe and having an internal conduit for liquid connecting to the body outlet and an external conduit for vapor return surrounding the liquid conduit, the two conduits defining an annular passage for conducting vapor from the vehicle tank to a vapor return conduit means in the nozzle body;

(c) a valve in the body for controlling the flow of liquid through said body from said inlet to said outlet;

(d) a manually operated means for controlling the operation of the valve and vacuum responsive release means to allow closing of said valve and stoppage of liquid flow when a predetermined partial vacuum is induced within the nozzle body;

(e) venturi means responsive to liquid flow through the body for inducing a partial vacuum and an interconnecting passage between the vapor return conduit means to the venturi means normally allowing the flow of vapor from said vapor return conduit means to said venturi means to limit the partial vacuum induced thereby and said interconnecting passage being located at a point in the vapor return conduit which becomes full of liquid at such times when liquid begins to be aspirated from the vehicle tank through the vapor return conduit; and (d) a check valve within the nozzle body for closing the vapor return conduit valve which is actuated to the open position by liquid pressure within the nozzle body when the control valve in the nozzle body is open.

In another aspect, the present invention involves a liquid dispensing nozzle for use in a vacuum assist vapor recovery system comprising a nozzle body having liquid conduit means for conducting liquid therethrough to a filling spout and vapor conduit means for conducting vapor therethrough from a vehicle tank being filled with liquid to a liquid storage tank. The liquid conduit means is provided with a manually actuated valve for controlling the flow of liquid to the spout and a vacuum responsive release means to allow closing of the valve and stoppage of liquid flow when a predetermined partial vacuum is induced. The liquid conduit means is also provided with a flow restricting venturi type orifice for creating a downstream zone of reduced pressure or relative partial vacuum and an upstream zone of higher pressure as liquid flows therethrough, and a check valve responsive to the thus created differential pressure is interposed in the vapor return conduit to seal same except at times when liquid is flowing through the liquid conduit creating a pressure differential.

BRIEF DESCRIPTION OF THE DRAWING

The drawing, which is partially in section, depicts a preferred embodiment of the dispensing nozzle of this invention.

DETAILED DESCRIPTION OF THE INVENTION

The major elements of the dispensing nozzle 10 are a nozzle body 11, a filling spout 12 and manual operating mechanism indicated at 13. The spout 12 is adapted to be loosely received in a vehicle tank fill pipe (not shown) in the manner shown and described in U.S. patent application Ser. No. 36,302. The spout 12 includes an inner liquid conduit 14 and a surrounding conduit 15 which together define a vapor return passage 16. The two conduits 14 and 15 are shown coaxially disposed so that the vapor return passge 16 is annular, but, as will be apparent to those familiar with the art, the inner conduit can be displaced even to the point of contacting the outer conduit without materially impairing vapor flow. Near the remote end of the spout 12 a number of holes 17 are provided through the outer conduit 15 so that vapor or, in the case where the vehicle tank is filled, liquid can enter the annular space 16. The holes 17 are preferably located near the end of spout 12, desirably within an inch or less. Alternatively, the inner conduit 14 can extend to the end of or beyond the outer conduit 15 and the holes 17 need not be provided. The other ends of conduits 14 and 15 are threadably attached to the body 11 as shown in the drawing so that the annular passage 16 is in communication with an annular space 18 provided within the body 11. The inner conduit 14 is in communication with a cylindrical space 20. For simplification the nozzle body 11 has been illustrated as largely monolithic. It will be appreciated, however, that the body can be fabricated from a number of individual elements to achieve the configuration shown. This type of fabrication is illustrated and described, for example, in the McMath and Ostand patents described above.

The flow path of liquid to be dispensed is through passage 21 within handle 22 past liquid flow control poppet valve 23 into central cavity 24. Central cavity 24 opens through a frustoconical passage 25 into cylindrical chamber 20 which in turn connects to the inner spout conduit 14. The frustoconical passage 25 is closed, except when liquid is being dispensed, by a conical valve element 26 which serves as a check valve when urged into closed position by spring 27 which abuts retainer 28 within the cylindrical passage 20.

The vapor return path through the dispensing nozzle 10 is through the annular passage 16 in spout 12 to annular space 18 which extends within the body 11 beyond the frustoconical passage 25 and opens into a shut-off valve chamber 30. The bottom of this chamber is in communication with a vapor return conduit 31 which connects with a vapor suction pump (not shown) as is described in U.S. patent application Ser. No. 36,302. For simplicity the vapor return conduit 31 has been shown as extending along handle guard 32. In most cases it is preferred to provide this conduit within the nozzle body 11 to either side of the plane on which the section is shown in the drawing. By this arrangement a more compact structure is obtained, but from an operational standpoint no appreciable difference results.

The liquid flow control poppet valve 23 is normally held closed by a spring 35 and it is opened by manually raising the operating mechanism lever 13 which elevates rod 36. When the valve 23 is in the open position liquid pressure from an external pump (not shown) enters the central cavity 24 and forces the conical valve member 26 away from the valve port 25 so that liquid flows into cylindrical opening 20, through inner spout conduit 14 and into the vehicle tank (not shown). Simultaneously, the external vacuum pump produces a suction through vapor return conduit 31 and withdraws vapor through openings 17, annular spout conduit 16 and through shut-off valve chamber 30. This chamber contains a shut-off or check valve 40, normally held in closed position by a spring 41. This valve is shown in partially open position. When fully open it can abut the top of chamber 30 and when closed should abut and seal off valve port 42. Shut-off valve 42 is operated by a diaphragm 43. The space below the diaphragm 43 is connected by a passage 44 to the central cavity 24, and when the control valve 23 is open the central cavity pressure forces the diaphragm 43 upwardly compressing spring 41 and opening valve 40. When control valve 23 is closed liquid pressure in cavity 24 vents past valve 26 and the shut-off valve 40 closes preventing the flow of vapors from the storage tank and interconnecting conduits from emerging from the nozzle into the atmosphere.

The arrangement for closing the liquid flow control valve 23 when a vehicle tank is filled comprises a flexible diaphragm 46 mounted within a vacuum chamber 47 and a latching mechanism actuated by movement of the diaphragm 46 to permit downward movement of the pivot end of the manual operating lever 13 when the diaphragm 46 is moved upwardly in response to increased vacuum induced in chamber 47. The latching mechanism is carried by an insert 48 mounted within body 11 and extending through the central cavity 24. The mechanism includes a latch retaining pin 50 attached to the diaphragm 46, a latch plunger 51 slideably received within a spring 52 in insert 48 and a plurality of lock balls 53 (two of which are shown) which hold latch plunger 51 stationary in the position illustrated except when the latch retaining pin 50 is moved upwardly by the action of the diaphragm 46. When the diaphragm 46 moves upwardly it withdraws latch retaining pin 50 permitting inward movement of the lock balls 53 and this, in turn, permits latch plunger 51 to move downwardly in response to pressure exerted by the large spring 35 which is compressed when lever 13 has been raised. The smaller spring 52 compresses as latch plunger 51 moves downwardly but functions to restore the mechanism to the position shown in the drawing after liquid flow has been shut off. Reference is made to U.S. Pat. No. 3,817,285 to Wilder et al. for a more complete description of the latching mechanism and its functioning when the diaphragm 46 is actuated.

The vacuum chamber 47 is connected by a small passage 55 and a larger passage 56 within the body 11 to a plurality of venturi passages 57 opening into the frustoconical port 25. This port and the conical valve member 26 constitute a venturi means together with the passages 57 when liquid is flowing and the valve port 25 is open. When liquid is flowing from the central cavity 24 through the port 25 a partial vacuum is induced in passages 57 and its effect is transmitted to the vacuum chamber 47.

One or more additional passages 58 connect the lower portion of the annular space 18 to the valve port 25 and the purpose of passage 58 is to partially destroy the venturi effect when liquid is not present in the annular space 18 by permitting vapor from space 18 to pass into valve port 25. When liquid is present in the annular space 18 it blocks passage 58 and increases the degree of the partial vacuum within vacuum chamber 47 causing the diaphragm 46 to overcome the force of spring 48 and actuate the latch mechanism to close the liquid flow control valve 23 shutting off liquid flow. Thus as long as liquid is not present in the annular passage 18 to block the passage 58, the nozzle 10 will function to dispense liquid and to recover vapor. However, when liquid is present in the vapor return conduit system in the vicinity of the passage 58, from whatever source, the nozzle will be shut off. Upon shut-off the pressure in the central cavity drops and diaphragm 43 no longer holds the vapor shut-off valve 40 open. When this valve closes the suction in chamber 30, in annular space 18 and in the annular passage 16 is relaxed and any liquid contained therein flows by gravity out of the nozzle and spout and into the vehicle tank.

An automobile service station was provided with a vapor recovery system such as is described in U.S. patent application Ser. No. 36,302. The individual dispensers were provided with dispensing nozzles fabricated in accordance with the present invention. The service station was operated on a customer self-service basis and it was found that customers had no more difficulty in dispensing fuel with the nozzles of this invention than with conventional nozzles not equipped for vapor recovery.

In order to determine the efficiency of the dispensing nozzle of this invention a test was performed in which a number of different vehicles were fueled to a total of 112 times from a number of different dispensers at the service station. During each fueling a vapor collection boot enclosing the mouth of the vehicle fill pipe and the dispensing nozzle was employed. Ambient air was aspirated through the boot and its volume and hydrocarbon content were measured for each fueling operation. From these measurements a calculation of the amount of fuel which would have escaped to the atmosphere was made and compared with the vapor volume displaced from the fuel tank. The average recovery of vapor was found to be 97.6% of the amount which would have been emitted with a conventional nozzle not equipped for vapor recovery.

A preferred embodiment of the dispensing nozzle has been shown and described. Various changes and modifications in this embodiment such as will present themselves to those familiar with the art may be made without departing from the spirit of this invention whose scope is commensurate with the following claims.

We claim:

1. A dispensing nozzle for use in a vacuum assist vapor recovery system, said nozzle comprising:

(a) a nozzle body having an inlet and an outlet for liquid to be dispensed;

(b) a filling spout attached to said nozzle body, said spout being adapted for loose fitting reception in a vehicle tank fill pipe and having an internal conduit for liquid connecting to said nozzle body outlet and an external conduit for vapor return surrounding the liquid conduit, said two conduits defining a passage for conducting vapor from the vehicle tank to a vapor return conduit means in said nozzle body;

(c) a control valve in said nozzle body for controlling the flow of liquid through said body from said inlet to said outlet;

(d) manually operated means for controlling the operation of said control valve and vacuum responsive release means to effect closing of said valve and stoppage of liquid flow when a predetermined partial vacuum is induced within said nozzle body;

(e) venturi means responsive to liquid flow, through said nozzle body for inducing a partial vacuum and an interconnecting passage between said vapor return conduit means to the venturi means, said passage normally allowing the flow of vapor from said vapor return conduit means to said venturi means to limit the partial vacuum induced thereby and said interconnecting passage being located at a point in the vapor return conduit which becomes full of liquid at such times when liquid begins to be aspirated from the vehicle tank through the vapor return conduit; and (f) a check valve within the nozzle body for closing said vapor return conduit which valve is actuated to an open position by liquid pressure within the nozzles body when said control valve in the nozzle body is open.

2. The dispensing nozzle of claim 1 wherein the venturi means includes a frustoconical valve port and a spring loaded frustoconical valve member which together constitute a check valve for closing the liquid dispensing conduit means when liquid is not being dispensed.

3. A dispensing nozzle for use in a vacuum assist vapor recovery system, said nozzle comprising:

(a) a nozzle body having an inlet and an outlet for liquid to be dispensed;

(b) a filling spout attached to said nozzle body said spout having an internal conduit for liquid connecting to said nozzle body outlet and an external conduit for vapor return surrounding the liquid conduit, said two conduits defining a passage for conducting vapor from the vehicle tank to a vapor return conduit means in said nozzle body;

(c) a control valve in said nozzle body for controlling the flow of liquid through said body from said inlet to said outlet;

(d) manually operated means for controlling the operation of said control valve and vacuum responsive release means to allow closing of said valve and stoppage of liquid flow when a predetermined partial vacuum is induced by the presence of aspirated liquid within said nozzle; and (e) a check valve within the nozzle body for closing said vapor return conduit which is actuated to an open position by liquid pressure within the nozzle body when the control valve in the nozzle body is open.

4. A liquid dispensing nozzle for use in a vacuum assist vapor recovery system, said nozzle comprising: a nozzle body having liquid conduit means for conducting liquid therethrough to a filling spout and vapor conduit means for conducting vapor therethrough from a vehicle tank being filled with liquid to a liquid storage tank, said liquid conduit means having a manually actuated valve for controlling the flow of liquid to the spout and a vacuum release means to allow closing of the valve and stoppage of liquid flow when a predetermined partial vacuum is induced, said liquid conduit means being also provided with a flow restricting venturi type orifice for creating a downstream zone of relative partial vacuum and an upstream zone of higher pressure as liquid flows therethrough, and a check valve responsive to the thus created differential pressure interposed in the vapor return conduit to seal same except at times when liquid is flowing through the liquid conduit creating a pressure differential.

* * * * *

UNITED STATES PATENT OFFICE

CERTIFICATE OF CORRECTION

Patent No. 4,429,725 Dated February 7, 1984

Inventor(s) Donald C. Walker and Theodore O. Wagner

It is certified that error appears in the above-identified patent and that said Letters Patent are hereby corrected as shown below:

Column 1, line 44, "an" should be --a--.
Column 2, line 51, "34-35" should be --34-53--.
Column 2, line 57, "system" should be --systems--.
Column 7, line 24, "nozzles" should be --nozzle--.
Column 8, line 27, "vacuum release" should be --vacuum responsive release--.

Signed and Sealed this Third Day of July 1984

[SEAL]

Attest:

GERALD J. MOSSINGHOFF

Attesting Officer

Commissioner of Patents and Trademarks